US006663514B2

(12) United States Patent
Niwa et al.

(10) Patent No.: US 6,663,514 B2
(45) Date of Patent: Dec. 16, 2003

(54) RACKET WITH VIBRATION DAMPING YOKE

(75) Inventors: Kunio Niwa, Hyogo (JP); Hiroyuki Takeuchi, Hyogo (JP); Takeshi Ashino, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/180,526

(22) Filed: Jun. 27, 2002

(65) Prior Publication Data

US 2003/0036447 A1 Feb. 20, 2003

(30) Foreign Application Priority Data

Jun. 29, 2001 (JP) ..... 2001-197920

(51) Int. Cl.[7] ..... A63B 49/00

(52) U.S. Cl. ..... 473/521; 473/546; 473/535; 473/537

(58) Field of Search ..... 473/520, 521, 473/524, 535, 536, 537, 546

(56) References Cited

U.S. PATENT DOCUMENTS

| | | | | | |
|---|---|---|---|---|---|
| 3,958,805 | A | * | 5/1976 | Cooper | 473/546 |
| 3,990,701 | A | * | 11/1976 | Kim | 473/535 |
| 4,141,551 | A | | 2/1979 | Goransson | |
| 4,166,616 | A | * | 9/1979 | Kohzu | 473/546 |
| 4,311,308 | A | | 1/1982 | Volkl et al. | |
| 4,634,124 | A | * | 1/1987 | Yuhas et al. | 473/521 |
| 6,500,080 | B2 | * | 12/2002 | Severa et al. | 473/521 |
| 2002/0165050 | A1 | * | 11/2002 | Severa et al. | 473/524 |
| 2003/0036447 | A1 | * | 2/2003 | Niwa et al. | 473/520 |

FOREIGN PATENT DOCUMENTS

| | | | |
|---|---|---|---|
| EP | 0214952 | A | 3/1987 |
| GB | 2 216 018 | A | 10/1989 |
| JP | 06-063183 | A | 3/1994 |
| JP | 2000-70415 | | 3/2000 |
| JP | 2000-070415 | A | 3/2000 |

* cited by examiner

*Primary Examiner*—Raleigh W. Chiu
(74) *Attorney, Agent, or Firm*—Birch, Stewart, Kolasch & Birch, LLP

(57) ABSTRACT

A frame body (2) is formed separately from a yoke (10) connecting right and left parts of the frame body (2) to each other. The yoke (10) and the frame body (2) are connected to each other by a mechanical connection means, with both ends of the yoke (10) in contact with the right and left parts of the frame body (2) in an area of not less than 10 $cm^2$ (1.6 $in^2$). A shear force generated when the racket frame (1) deforms is collectively applied to a connection surface of the frame body (2) and that of the yoke (10) to increase a vibration-damping performance of the racket frame (1).

16 Claims, 9 Drawing Sheets

Fig. 8A
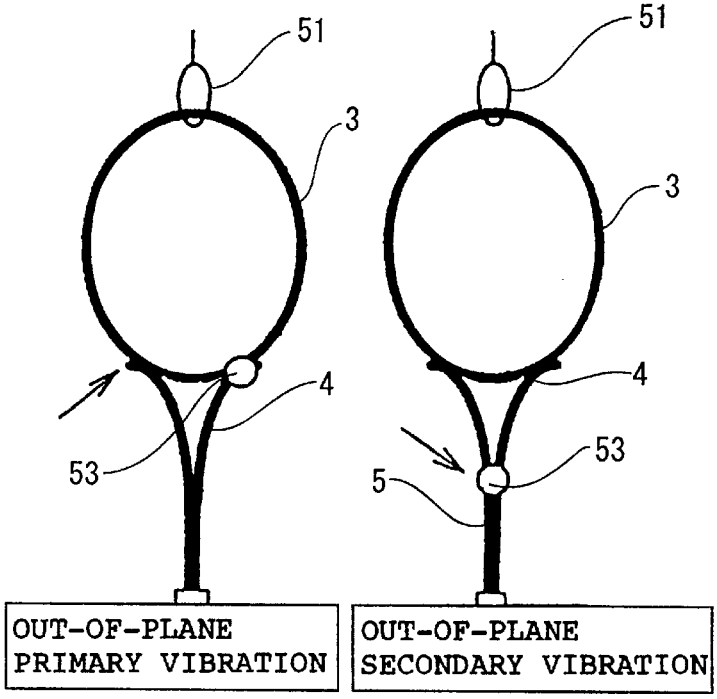
Fig. 8C
(⟶ POSITION TO BE HIT IMPACT HAMMER)
Fig. 8B
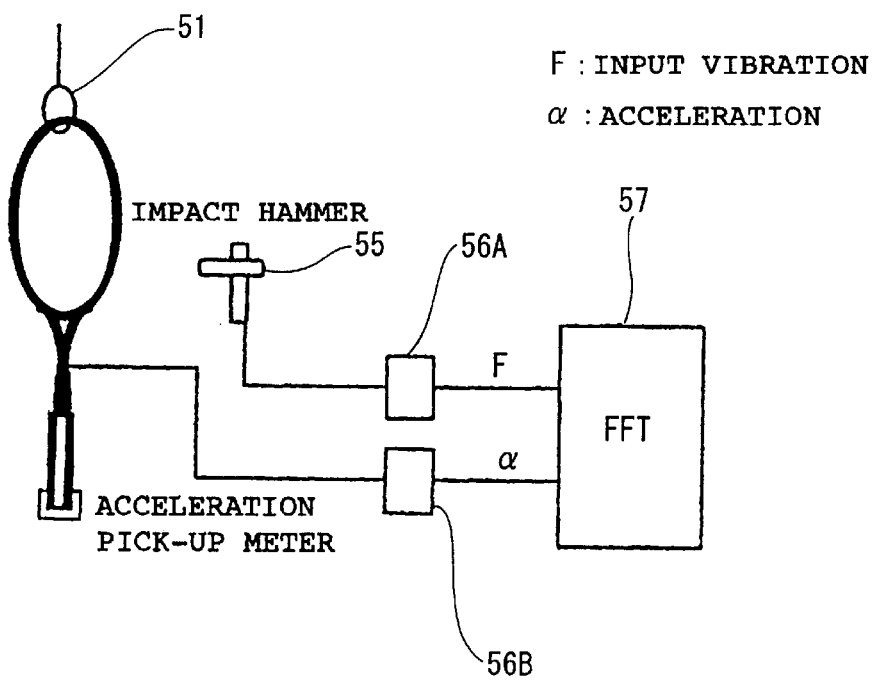

RACKET WITH VIBRATION DAMPING YOKE

BACKGROUND OF THE INVENTION

1. Field of the Invention

The present invention relates to a racket frame and in particular, a tennis racket frame. More particularly, the present invention is intended to increase the vibration-damping performance of the racket frame by improving a connection portion of a frame body of the racket frame and that of a yoke thereof.

2. Description of the Related Art

In recent years, the racket frame is demanded to have a light weight, a high rigidity, a high strength, and a high durability. The fiber reinforced resin (hereinafter referred to as FRP) is the most popular material for the racket frame. Normally the racket frame is formed by molding a thermosetting resin reinforced with a fiber such as a carbon fiber having a high strength and elastic modulus.

The FRP containing the thermosetting resin as the matrix resin is superior owing to its high rigidity, but the FRP is apt to vibrate when it is subjected to a shock, thus causing a tennis player to suffer tennis elbow frequently.

Therefore an organic fiber such as an aramid fiber or an ultra-high-molecular-weight polyester fiber may be used to improve the vibration-damping performance of an FRP composed of an epoxy resin serving as the matrix resin and a continuous carbon fiber serving as the reinforcing fiber. However, the FRP reinforced with the organic fiber has a vibration-damping performance of less than 0.6 that is not so high and a low rigidity and strength. Thus the FRP reinforced only with an organic fiber has a problem with respect to its rigidity.

To overcome the problem, in recent years, there is proposed a racket frame composed of a fiber-reinforced thermoplastic resin containing a thermoplastic resin, superior in its vibration-damping performance, serving as the matrix resin. For instance, the fiber-reinforced resin contains a polyamide resin and a continuous fiber or a short fiber serving as the reinforcing fiber. Methods for manufacturing the fiber-reinforced thermoplastic resin are classified into the following three methods. In each case, the frame body of the racket frame made of the fiber-reinforced thermoplastic resin has a vibration-damping factor not less than 0.9.

(1) The polyamide resin containing the short fiber is injection-molded (vibration-damping factor: 1.9%).

(2) A fibrous material serving as the matrix resin and the reinforcing fiber are layered on each other in a fibrous configuration. An internal pressure is applied to the laminate at a high temperature to fuse the matrix resin and mold the laminate (vibration-damping factor: 0.92%).

(3) A reaction injection molding (RIM) of the polyamide resin monomer is performed, with the reinforcing fiber set in a die (vibration-damping factor: 1.1%).

The frame body of the racket frame made of the fiber-reinforced thermoplastic resin reflects the high toughness of the thermoplastic resin, thus having characteristics such as a high resistance to shock and a high vibration-damping performance that cannot be attained by the conventional frame body made of the thermosetting resin.

However, a thermoplastic resin depends on an environment for its elastic modulus and strength more than a thermosetting resin. Thus depending upon the environment in which the frame body of the racket frame is used, the characteristic of the thermoplastic resin such as rigidity is liable to change.

To solve these problems of a frame body of a racket frame composed of a matrix resin consisting of a thermoplastic resin and a frame body composed of a matrix resin consisting of a thermosetting resin, a frame body containing a combination of a thermoplastic resin and a thermosetting resin is proposed.

For example, in Japanese Patent Application Laid-Open No. 6-63183, the region from the throat part to the grip part is formed of a thermoplastic resin as the matrix resin, and the string-stretched part (face part) surrounding the ball-hitting face is formed of a thermosetting resin as the matrix resin.

In Japanese Patent Application Laid-Open No. 2000-70415, the yoke is formed of nylon made by reaction injection molding and a carbon fiber. Then the yoke is set in a die for the frame body to integrally mold the yoke and a laminate of an unhardened prepreg of the carbon fiber and an epoxy resin.

In the racket frame disclosed in Japanese Patent Application Laid-Open No. 6-63183, half of the body thereof is formed of a thermoplastic resin, as the matrix resin, which is liable to change in its characteristic depending upon the environment in which the frame body of the racket frame is used, and the vibration mode of a tennis racket composed of the racket frame is not considered. Thus this racket frame does not have effective vibration-damping performance.

In the racket frame disclosed in Japanese Patent Application Laid-Open No. 2000-70415, the connection portion of the yoke and of the frame body is subjected to a string tension and a load applied to the string by a tennis ball. Thus it is necessary to firmly bond the yoke and the frame body to each other by one-piece molding. Actually the connection portion of the yoke and of the frame body crack. Further a shear stress is generated on the interface of the connection portion. It is impossible for the connection portion to suppress the vibration of the racket frame.

The art demands a racket frame having increased vibration-damping performance. In addition, a tennis racket having high operability to cope with a play style of giving a tennis ball a spin is demanded. Therefore there is a growing demand for development of a lightweight (reduced moment of inertia) racket frame.

A player gives the tennis ball a spin by using a wide portion of the ball-hitting face as a hitting point. Thus the player desires a tennis racket having a large sweet spot.

It is desired that a tennis racket for a contestant have a stable ball-hitting face. It has been revealed that the rigidity in the in-plane direction is important.

As described above, a racket frame is demanded having light weight, high operability, high rigidity, high strength, high durability, high restitution performance, high stability in its ball-hitting face, and high vibration-damping performance.

SUMMARY OF THE INVENTION

The present invention has been made in view of the above-described demands. Thus, it is an object of the present invention to provide a racket frame that is lightweight, stable in rigidity, has a proper vibration-damping performance, and can control the degree of the vibration-damping performance.

In order to achieve the object, according to the present invention, a connection portion of the yoke and the frame body thereof is improved so that the connection portion suppresses vibrations effectively. To do so, materials can be arbitrarily selected for the frame body to allow the frame body to be lightweight and have an appropriate rigidity and strength.

More specifically, the present invention provides a racket frame in which a frame body is formed separately from a yoke connecting right and left parts of the frame body to each other; and the yoke and the frame body are connected to each other by a mechanical connection means or/and an adhesive agent, with both ends of the yoke in contact with the right and left parts of the body in an area of not less than 10 $cm^2$ (1.6 $in^2$).

It is preferable that a shear force generated when the racket frame deforms is collectively applied to a connection surface of the frame body and the yoke to increase the vibration-damping performance of the racket frame.

In the conventional racket frame composed of a FRP, the portion where the yoke and the frame body are connected to each other is integrally formed when the frame body is formed by molding a material. The resin for the yoke and the resin for the frame body are fused and integrated with each other to a high degree. Therefore a stress is collectively applied to the connection surface (boundary) of the frame body and that of the yoke when a tennis racket deforms.

On the other hand, in the case where the yoke and the frame body are bonded to each other to a low degree when a material for the yoke and a material for the frame body are integrally molded, a shear load is collectively applied to the boundary between the yoke and the frame body when the racket frame deforms. As a result, the boundary cracks.

On the other hand, according to the present invention, the material for the yoke and the material for the frame body are not integrally molded but separately molded, and the yoke and the frame body are connected to each other by a mechanical connection means.

Therefore it is possible to secure the force of connecting the yoke and the frame body to each other. Since the connection surface of the yoke and that of the frame body are not integrated with each other, a shear load which is generated when the racket frame deforms is collectively applied to the boundary between the yoke and the frame body. Thereby vibrations generated on the entire racket frame are suppressed.

The connection portion of the yoke and the frame body deform greatly in the primary and secondary vibrations in the out-of-plane direction. Thus the shear load can be collectively applied to the boundary between the yoke and the frame body. Consequently it is possible to effectively suppress vibrations generated on the entire racket frame. Thus the racket frame of the present invention has a high vibration-damping performance.

By changing the area of the connection portion of the yoke and that of the frame body, the vibration-damping performance can be controlled. Thus it is possible to appropriately set the degree of the vibration-damping performance according to a player preference for the degree of vibration generated when the player hits a tennis ball.

The area of the connection portion between both ends of the yoke and the right and left parts of the frame body is not less than 10 $cm^2$ (1.6 $in^2$), favorably not less than 20 $cm^2$ (3.2 $in^2$), and more favorably not less than 30 $cm^2$ (4.8 $in^2$). If the area of the connection portion is less than 10 $cm^2$ (1.6 $in^2$), a sufficient vibration-damping effect cannot be obtained. From the viewpoint of the vibration-damping performance, it is desirable that the area of the connection portion is large. But in view of the strength and weight of the racket frame, the area of the connection portion is favorably less than 60 $cm^2$ (9.0 $in^2$).

The frame body is composed of a pipe formed by one-piece molding of the FRP. The frame body has a string-stretched part surrounding a ball-hitting face, a throat part, a shaft part, and a grip part continuously formed. By forming the frame body from one component part, the shear load is collectively applied to the boundary between the yoke and the frame body.

It is preferable to use continuous fibers as the reinforcing fiber of the frame body to make it lightweight, rigid, and strong. It is possible to use a thermosetting resin as the matrix resin of the frame body to increase its strength and rigidity or a thermoplastic resin to increase its vibration-damping performance. That is, by allowing the connection surface of the yoke and that of the frame body to have the vibration-damping function, the FRP of the frame body is selected as desired depending upon the main function of the racket frame.

The yoke is formed of FRP, resin, metal or wood or a composite material thereof.

As the metal, it is favorable to use a lightweight metal such as aluminum, titanium, magnesium, and the like or alloys containing one of these lightweight metals as the main component. To allow the racket frame to have a high vibration-damping effect, it is more favorable to use the fiber-reinforced thermoplastic resin. As the matrix resin, polyamide resin and an alloy of polyamide and ABS are preferably used.

The yoke is manufactured by a method of injection-molding the thermoplastic resin or the like reinforced with a short fiber such as a carbon fiber or the like; a method of weaving combed yarns of a polyamide fiber and a carbon fiber into braids and fusing the polyamide to impregnate the reinforcing fiber into the polyamide; or a method of forming RIM nylon by injecting a RIM nylon monomer into a laminate consisting of foamed epoxy, a nylon tube coating the foamed epoxy, and carbon braids layered on the nylon tube.

A mechanical connection means connects objects to each other without the intermediary of a viscous material or a chemical connection force. A mechanical connection means is used to connect the objects to each other depending upon a difference in the configuration of the objects and a combination of variations thereof. Mechanical connection means include fit-on of a concavity and a convexity, screw-tightening, fitting, engagement, locking, bolt/nut, spring, and the like. Of these means, the fit-on and the screw-tightening are favorably used.

The mechanical connection means is required to hold a string force and withstand an impact force applied to the racket frame by a tennis ball.

More specifically, a convexity is formed on the inner side of the frame body or the connection surface of the yoke, while a concavity which fits on the convexity is formed on the inner side of the frame body or the connection surface of the yoke. The yoke and the frame body fit on each other by fit-on of the convexity and the concavity.

In this case, in the case where the convexity is formed on the frame body and the concavity is formed on the yoke, the restraint on the yoke relative to the frame body is small. Thus it is easy to fit the yoke and the frame body on each other. It is preferable that the frame body has a depression corresponding to the configuration of the connection auxiliary part of the yoke to fittingly lock the connection auxiliary part and the frame body to each other. Thereby it is possible to prevent both from shifting from each other and enhance the connection therebetween.

An adhesive agent superior in vibration-absorbing property or/and a vibration-damping film or a vibration-damping sheet may be interposed between the connection surface of the frame body and that of the yoke.

That is, in addition to the mechanical connection means, an adhesive agent having a lower elastic modulus than the yoke and the frame body may be used in connecting the yoke and the frame body to each other. In this case, an adhesive effect is added to the effect of the mechanical connection.

Since the adhesive agent has a lower elastic modulus than the yoke and the frame body, it is possible to collectively apply the shear stress to the connection surface of the frame body and that of the yoke. Further by selecting an appropriate adhesive agent, it is possible to adjust the vibration-damping performance of the entire racket frame.

Furthermore a high vibration-damping material (film, sheet or vibration-damping paint) may be disposed on at least one portion between the connection surface of the frame body and that of the yoke. By selecting an appropriate vibration-damping material, it is possible to adjust the vibration-damping performance of the entire racket frame.

The vibration-damping material may be used singly or in combination with an adhesive agent.

By interposing the adhesive agent and/or the vibration-damping material between the connection surface of the frame body and that of the yoke, it is possible to prevent generation of an unpleasant sound.

As the vibration-damping film, dipole gee film manufactured by C.C.I. Inc. is preferably used.

As the adhesive agent, those flexible are preferable. In addition to those composed of epoxy resin, those composed of urethane are preferable. Concrete examples are shown below.

- A high separation-resistant and shock-resistant adhesive agent containing cyanoacrylate and elastomer as its base. For example, 1731•1733 produced by Three-Bond, Inc. is commercially available.
- A cold-cure type two-pack epoxy resin having stable toughness formed by uniformly dispersing fine rubber particles in the epoxy resin. As an adhesive agent under a high shear, 2082C produced by Three-Bond, Inc. is commercially available.
- An elastic adhesive agent of one-can moisture-cure type which contains a silyl group-containing specific polymer as its main component and hardens in reaction with a slight amount of water contained in air. For example, 1530 produced by Three-Bond, Inc. is commercially available.
- A urethane resin adhesive agent: "Esprene" is commercially available.
- "Redux 609", "AW106/HV953U", and "AW136A/B" produced by Ciba-Geigy, Inc. are commercially available.
- "E-214" produced by LOCTITE, Inc. is commercially available.
- "DP-460" and "9323B/A" produced by 3M, Inc. are commercially available.

It is preferable that the yoke has right and left connection auxiliary parts each extending from one end of a main part of the yoke that closes an opening of the string-stretched part, with each of the right and left connection auxiliary parts extending across a boundary between the string-stretched part and the throat part; each of the right and left connection auxiliary parts is extended up to a position of four o'clock (eight o'clock) of the string-stretched part, supposing that the string-stretched part is a clock face and that the top position of the string-stretched part is 12 o'clock; and each of the right and left connection auxiliary parts is extended up to the shaft part.

The connection auxiliary part allows the yoke and the frame body to be connected to each other in a large area and thus the connection surface of each of the yoke and the frame body to easily receive a shear load. By collectively applying a stress to each of the connection surfaces, a high vibration-damping function can be easily displayed, and the yoke can be connected to the frame body with a strong force.

The connection auxiliary part is extended up to the position of four o'clock (eight o'clock). The position of four o'clock (eight o'clock) is included in the loop of the secondary vibration mode. Thus the vibration-damping effect can be increased by extending the connection auxiliary part to the position of four o'clock (eight o'clock). When the connection auxiliary part is extended toward the position of 12 o'clock beyond the position of four o'clock, the racket frame has a large balance and a low operability.

At the throat-part side, the connection auxiliary part may be extended to the shaft-part.

By adjusting the extension length of the connection auxiliary part to the string-stretched part and to the throat part, the vibration-damping performance can be controlled and the balance point can be adjusted. Further by adjusting the extension length of the connection auxiliary part to the string-stretched part, the area of the ball-hitting face can be also altered. Furthermore by altering the position of the main part of the yoke to the top side of the entire racket frame or the grip side thereof, the area of the ball-hitting face of the racket frame can be easily altered.

Each of the right and left connection auxiliary parts has an equal and uniform dimension in one region and a nonuniform dimension in other region in a thickness direction thereof. The dimension of the connection auxiliary part in its thickness direction is set smaller than that of the frame body in its thickness direction to prevent the connection auxiliary part from projecting from the frame body.

By making the dimension of the connection auxiliary part in its thickness direction nonuniform, it is possible to fit the convexity of the frame body and the concavity of the connection auxiliary part on each other or the concavity of the frame body and the convexity of the connection auxiliary part on each other with a higher force and make the connection auxiliary part look attractive.

Preferably, each of the right and left connection auxiliary parts of the yoke is extended to the shaft part along an inner surf ace of the throat part in such a way that a leading end of the right connection auxiliary part is continuous with that of the left connection auxiliary part to form an approximately hollow triangular space with the connection auxiliary part and the main part of the yoke. This configuration increases the strength of the yoke.

It is preferable that the yoke has a projection projected from a portion at which the leading end of the right connection auxiliary part is continuous with the leading end of the left connection auxiliary part toward the shaft part. It is preferable that the projection is inserted into a slit formed at a center of a leading end of the shaft part. By inserting the projection into the slit formed on the shaft part, it is easy to dispose the yoke at a predetermined position of the frame body and connect the yoke and the frame body to each other in a large area to thereby enhance the vibration-damping performance of the racket frame.

It is preferable that an inner-side diameter of a string opening which is formed on the yoke and the frame body and which contacts a ball-hitting face of the racket frame is set large.

By making the string opening large in this manner, it is possible to prevent a dislocation of its position and enlarge the deformable length of the string. Thus it is possible to make the substantial ball-hitting area large and thus the sweet area large to obtain a high restitution performance.

To effectively utilize the length of the string and enlarge the sweet area by enlarging the string opening, it is effective to form large string openings at both ends of each of the vertical and horizontal strings.

In the case where the yoke and the frame body are formed by one-piece molding, it is very difficult to increase the diameter of the string opening of the yoke. On the other hand, in the present invention, since the yoke is formed separately from the frame body, it is possible to increase the diameter of the string opening of the yoke before the yoke is connected to the frame body. Consequently it is easy to enlarge the sweet area.

Both ends of the main part of the yoke and of a connection auxiliary part extending from both ends of the main part of the yoke are connected to an inner-surface side of the frame body by superimposing an outer surface of the connection auxiliary part and an inner surface of the frame body on each other (former construction). Otherwise, the yoke and the frame body are connected to each other by fitting the connection auxiliary part on a fit-on portion formed on the inner surface of the frame body in correspondence to a configuration of the connection auxiliary part (latter construction). The former construction is larger in the area of the contact between the yoke and the frame body than the latter construction. The latter construction allows the racket frame to be lightweight.

The weight of the yoke is set to a range of 5%–30% of the weight of a raw frame whose weight is the addition of the weight of the yoke and that of the frame body.

If the weight of the yoke is less than 5% of the weight of the raw frame, the yoke has a low strength. On the other hand, if the weight of the yoke is more than 30% of the weight of the raw frame, the weight of the yoke is too large. Preferably, the weight of the yoke is in the range of 10%–25% of the weight of the raw frame.

It is preferable to dispose a groove on the yoke at the side of the ball-hitting face along the peripheral direction of the ball-hitting face. Thereby the effective length of the string can be increased by the depth of the groove.

The resin for use in the racket frame of the present invention includes a thermosetting resin and a thermoplastic resin, as described above. Thermosetting resins include epoxy resin, unsaturated polyester resin, phenol resin, melamine resin, urea resin, diallyl phthalate resin, polyurethane resin, polyimide resin, and silicon resin. Thermoplastic resins include polyamide resin, saturated polyester resin, polycarbonate resin, ABS resin, polyvinyl chloride resin, polyacetal resin, polystyrene resin, polyethylene resin, polyvinyl acetate, AS resin, methacrylate resin, polypropylene resin, and fluorine resin.

As reinforcing fibers for use in the fiber reinforced resin, fibers which are used as high-performance reinforcing fibers can be used. For example, it is possible to use carbon fiber, graphite fiber, aramid fiber, silicon fiber, alumina fiber, boron fiber, glass fiber, aromatic polyamide fiber, aromatic polyester fiber, ultra-high-molecular-weight polyethylene fiber, and the like. Metal fibers may be used as the reinforcing fiber. The carbon fiber is preferable because it is lightweight and has a high strength. These reinforcing fibers can be used in the form of long or short fibers. A mixture of two or more of these reinforcing fibers may be used. The configuration and arrangement of the reinforcing fibers are not specifically limited. For example, they may be arranged in a single direction or a random direction. The reinforcing fibers may have the shape of a sheet, a mat, fabrics, braids, and the like.

The frame body is not limited to a laminate of fiber reinforced prepregs. The frame body may be formed by winding reinforcing fibers on a mandrel by filament winding to form a layup, disposing the layup in a die, and filling the thermoplastic resin such as RIM nylon into the die.

BRIEF DESCRIPTION OF THE DRAWINGS

FIGS. 8A, 8B, and 8C are schematic views showing methods of measuring the vibration-damping factor of the racket frame.

DETAILED DESCRIPTION OF THE PREFERRED EMBODIMENTS

Figure 1:
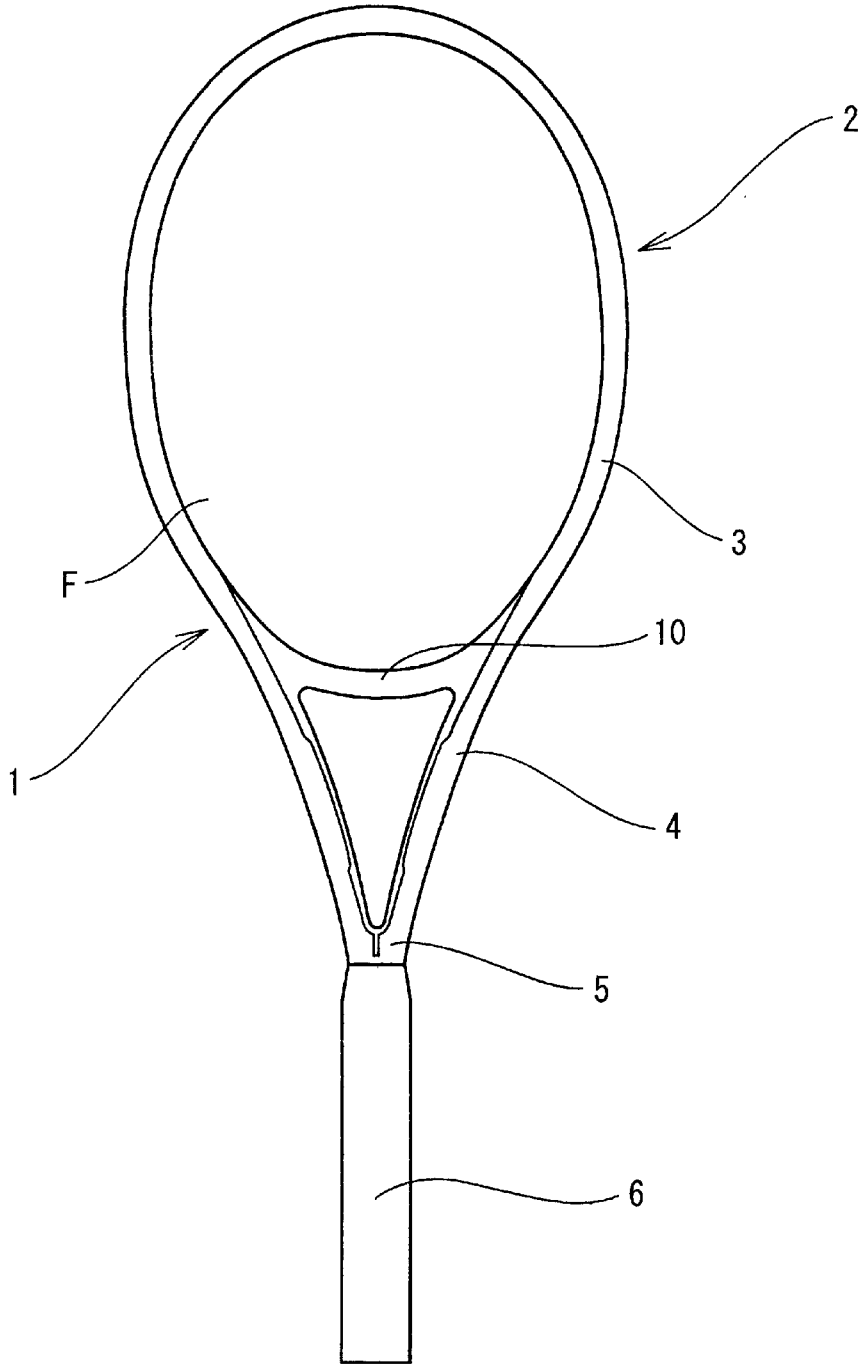
FIG. 1 is a schematic front view showing a racket frame according to a first embodiment of the present invention.
Figure 2:
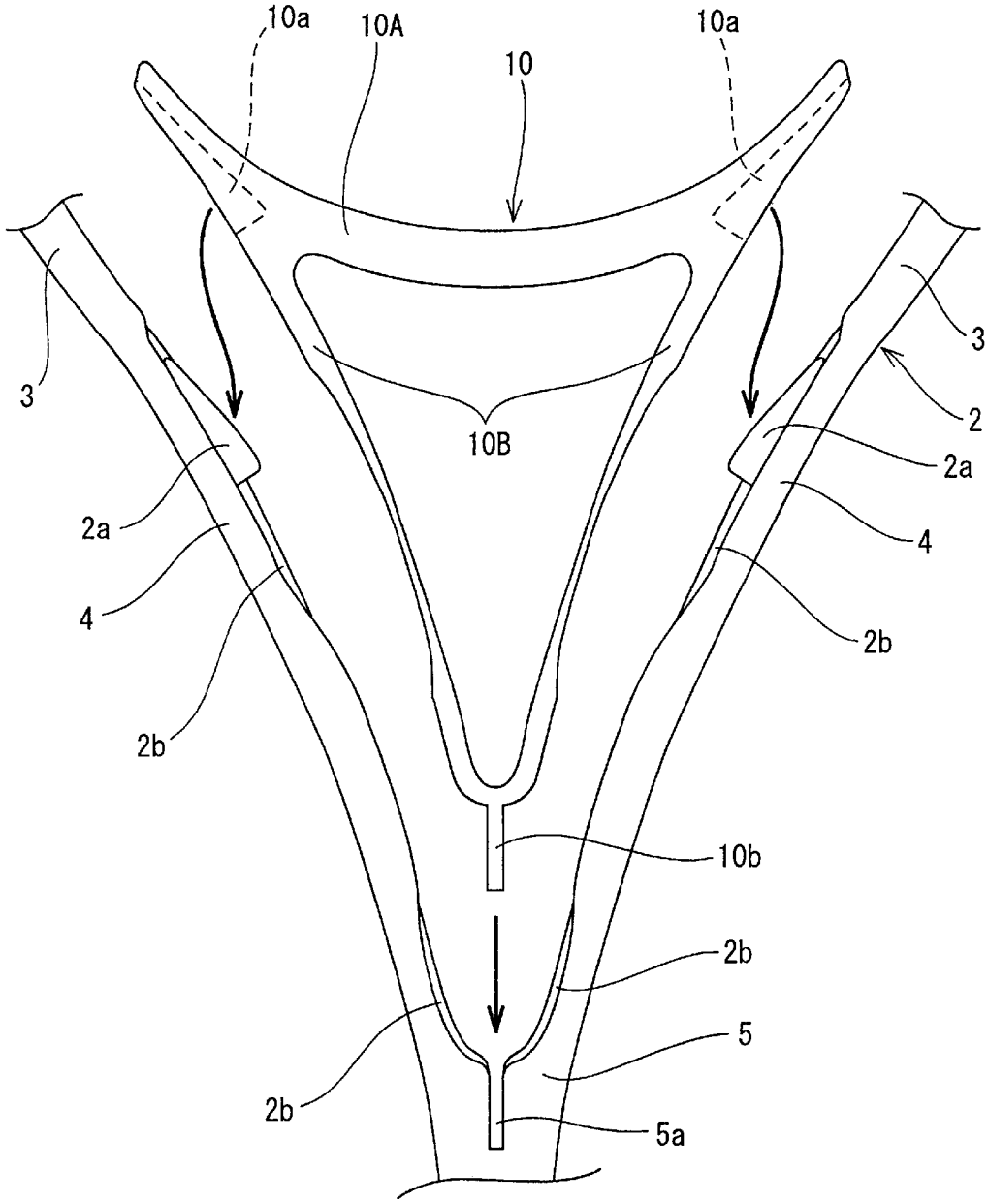
FIG. 2 is an enlarged view showing main portions of the body of a racket frame and a yoke.

The embodiments of the present invention will be described below with reference to the drawings.

FIGS. 1 through 5 show a racket frame 1 according to a first embodiment of the present invention. The racket frame 1 is composed of a frame body 2 thereof and a yoke 10 formed separately from the frame body 2. The frame body 2 is composed of a string-stretched part 3 surrounding a ball-hitting face F, a throat part 4, a shaft part 5, and a grip part 6. These parts 3 through 6 are continuously formed.

The yoke 10 is connected to right and left throat parts 4 of the frame body 2 and the string-stretched part 3 thereof. The frame body 2 and the yoke 10 are connected to each other in an area of 35 $cm^2$ (5.3 $in^2$) at each of the right and left sides thereof. Thus the joining surface has 70 $cm^2$ (10.6 $in^2$) in total. The yoke 10 has a main part 10A closing an opening of the gut-stretched part 3 and a connection auxiliary part 10B extending from both ends of the main body 10A, with the connection auxiliary part 10B extending across the boundary between the string-stretched part 3 and the throat part 4.

The main part 10A of the yoke has a concavity 10*a* formed thereon. The yoke 10 and the frame body 2 of the racket frame 1 are mechanically connected with each other by fitting a convexity 2*a* of the frame body 2 and the concavity 10*a* on each other. In addition to the mechanical connection, the yoke 10 and the frame body 2 are connected to each other with a urethane adhesive agent. A shear force generated when the racket frame 1 deforms is collectively applied to the connection surface of the frame body 2 and that of the yoke 10 connected to each other in this manner to increase the vibration-damping performance of the racket frame 1.

The connection auxiliary part 10B is extended to the position of five o'clock (seven o'clock) of the string-stretched part 3, supposing that the string-stretched part 3 is a clock face. The connection auxiliary part 10B is also extended to the shaft part 5 along the inner surface of the throat part 4. The leading end of the right connection auxiliary part 10B is continuous with that of the left connection auxiliary part 10B to form a hollow triangular space with the connection auxiliary part 10B and the main part 10A. A depression 2*b* corresponding to the configuration of the connection auxiliary part 10B is formed on the frame body 2 to lock the connection auxiliary part 10B to the depression 2*b* by fitting both on each other.

The yoke 10 has a projection lob projected from the portion at which the leading end of the right connection auxiliary part 10B is continuous with that of the left connection auxiliary part 10B toward the shaft part 5. The projection 10*b* is inserted into a slit 5*a* formed at the center of a leading end of the shaft part 5. The depth of the slit 5*a* is a little longer than the length of the projection 10*b* to allow the projection 10*b* to be inserted thereinto easily.

Figure 3A:
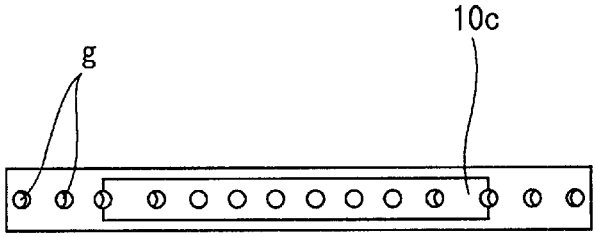
FIG. 3A is a plan view showing the yoke.
Figure 3B:
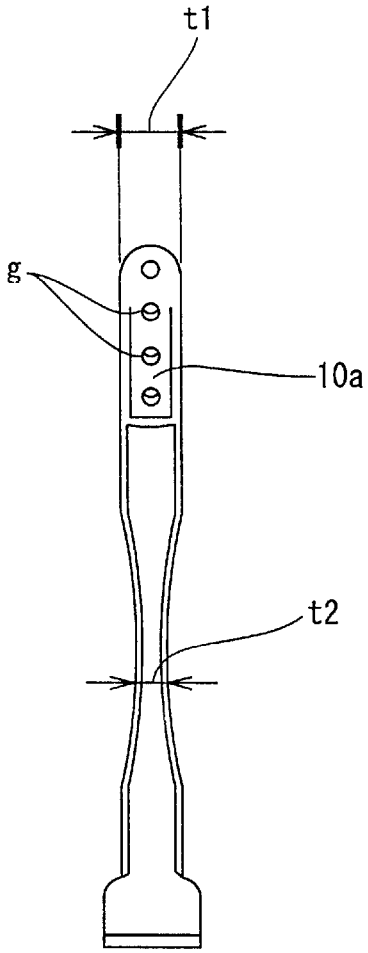
FIG. 3B is a side view showing the yoke.
Figure 3C:
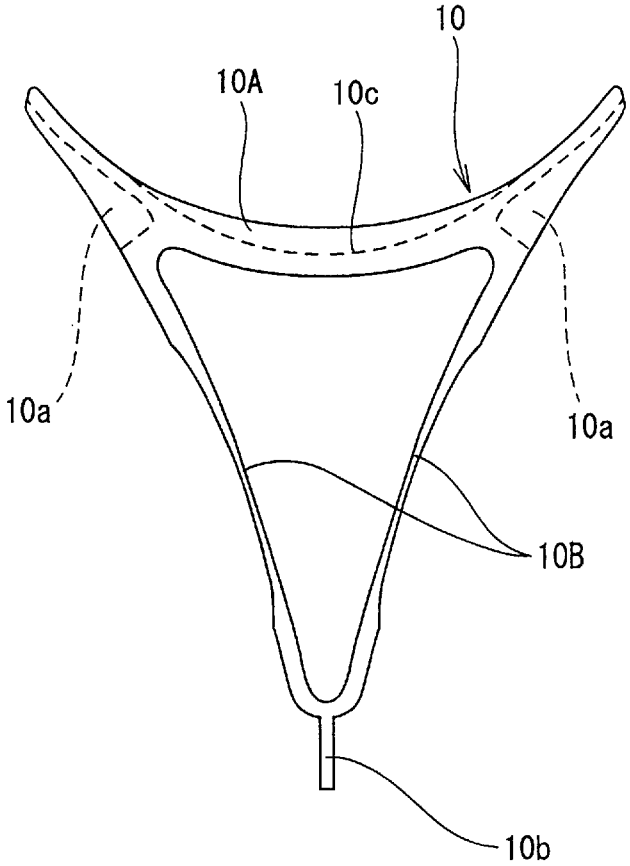
FIG. 3C is a front view showing the yoke.
Figure 4:
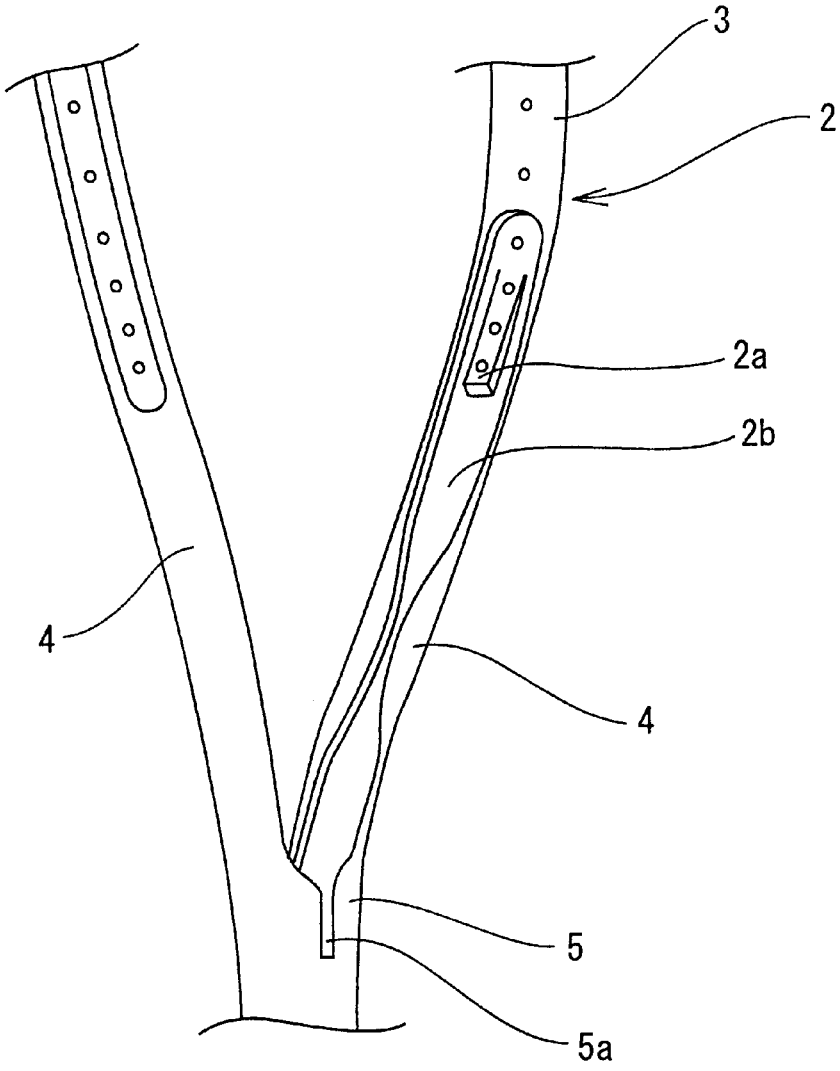
FIG. 4 is a perspective view showing the body of the racket frame.
Figure 5:
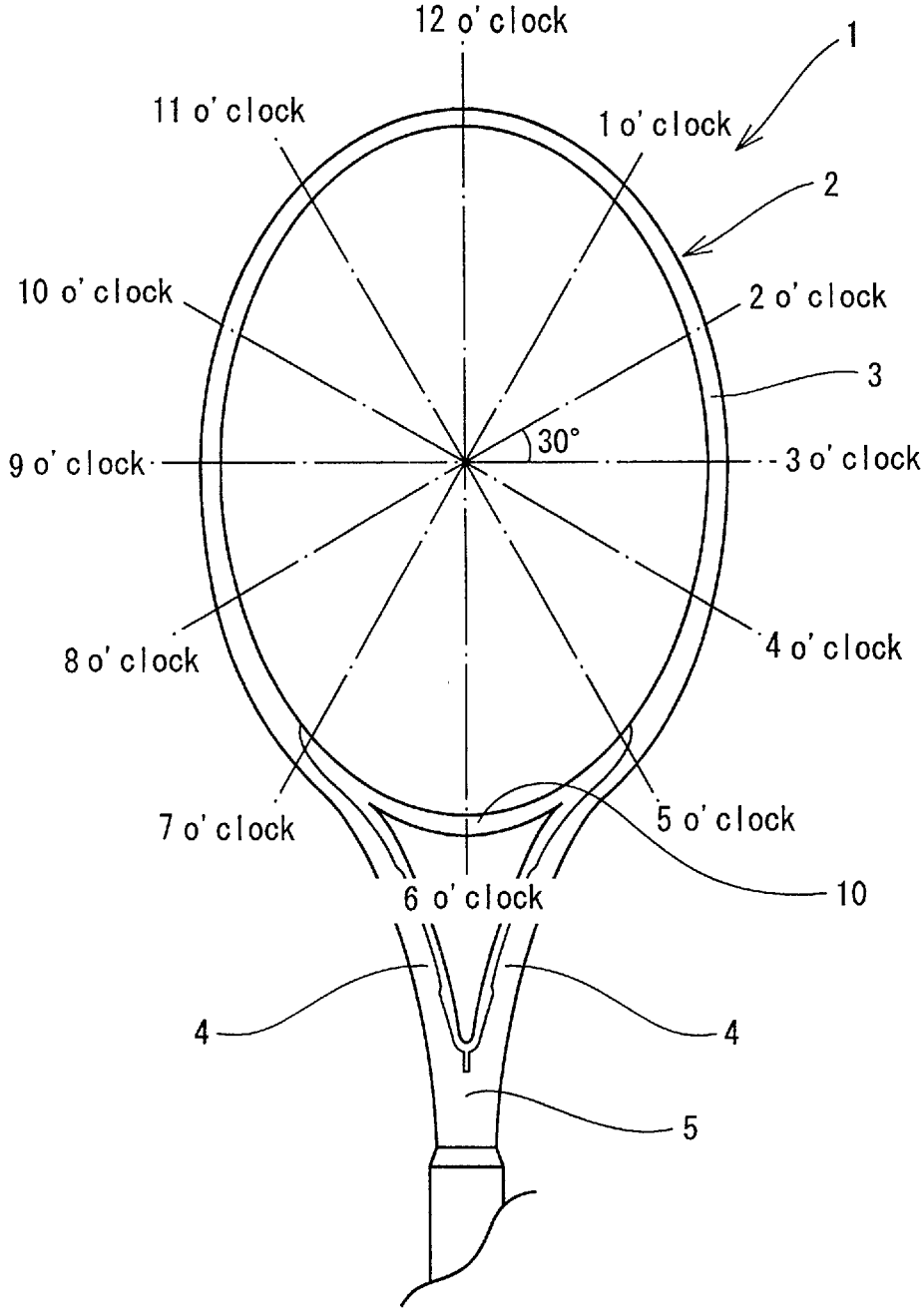
FIG. 5 shows a yoke-installing situation of the yoke.

With reference to FIG. 3, each of the right and left connection auxiliary part 10B has a uniform thickness t1 in the thickness direction of the racket frame 1 in the vicinity of the main part 10A and in the vicinity of the portion of the connection between the connection auxiliary part 10B and the shaft part 5. On the other hand, each of the right and left connection auxiliary part 10B has a gradually decreased thickness toward a point, having a thickness t2, corresponding to approximately the center of the throat part 4.

Figure 6:
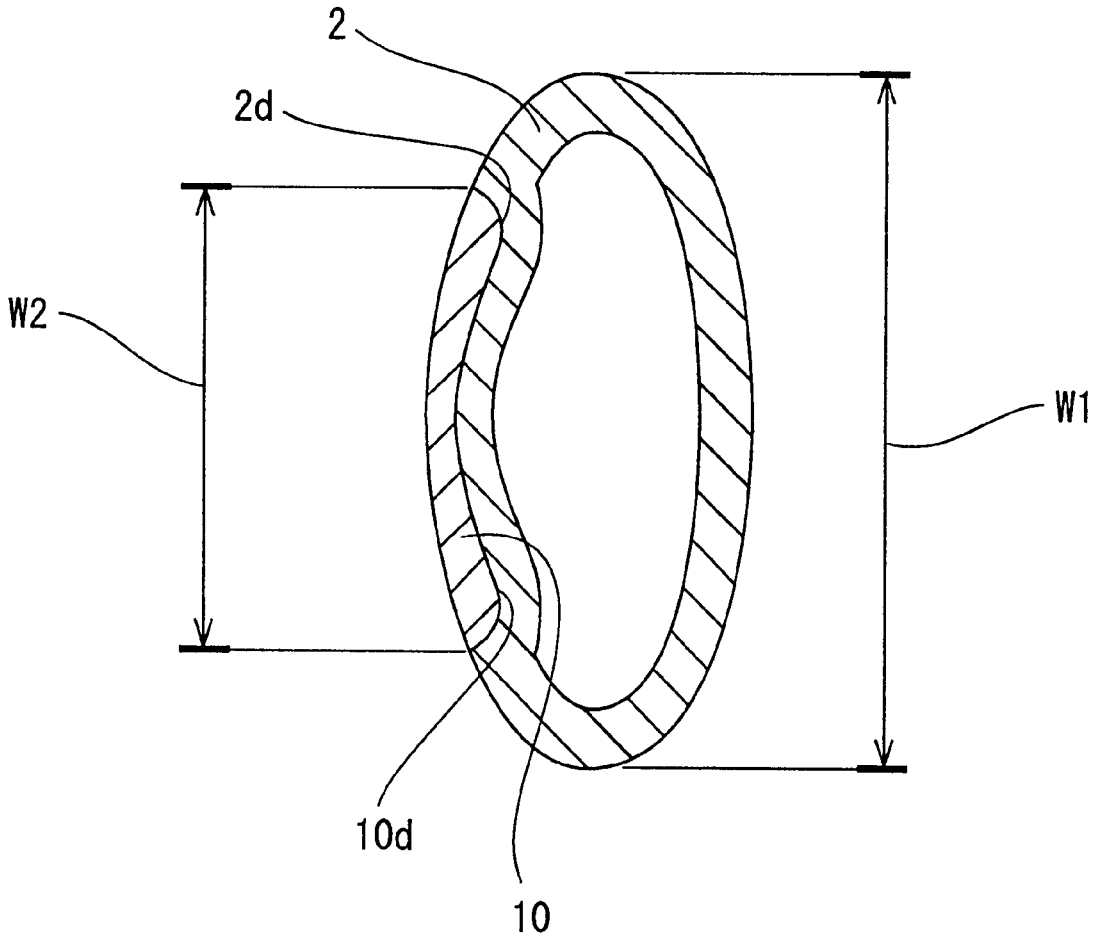
FIG. 6 is a sectional view showing a throat part.

As shown in FIG. 6, the yoke 10 (both ends of the main part 10A and the connection auxiliary part 10B extending from both ends of the main part 10A) is connected to the frame body 2 at its inner-surface side by connecting an outer surface 10*d* of the yoke 10 (both ends of the main part 10A and the connection auxiliary part 10B extending from both ends of the main part 10A) and an inner surface 2*d* of th frame body 2 to each other. A dimension W2 of the connection auxiliary part 10B in its thickness direction is set smaller than a dimension W1 of the frame body 2 in its thickness direction to prevent the yoke 10 from projecting from the frame body 2.

Figure 7:
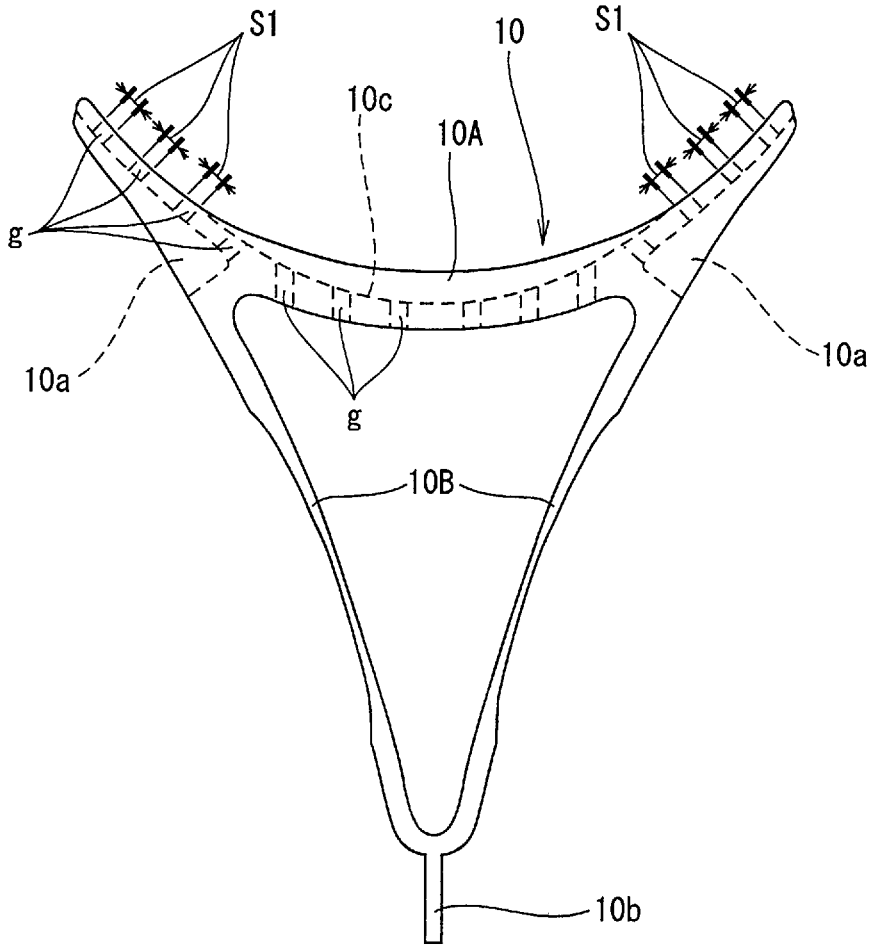
FIG. 7 shows the relationship between the yoke and a gut opening.

As shown in FIGS. 3 and 7, of the string openings g formed on the yoke 10, the inner-side diameter S1 of the string opening g which is located at a position corresponding to the neighborhood of the five o'clock (seven o'clock) of the string-stretched part 3 and which contacts the ball-hitting face F is set to 7 mm (0.28 in) which is larger than diameters of other portions of the string opening g. A groove 10*c* having a width of 5 mm (0.20 in) and a depth of 5 mm (0.2 in) is disposed at the side of the ball-hitting face of the yoke body 10A.

The weight of the yoke 10 is set to 33 g (0.073 lbs.) which is about 17% of the weight of a raw frame whose weight is the addition of the weight of the yoke 10 and that of the frame body 2. The ball-hitting area is set to 110 square inches (710 $cm^2$). The weight of the racket frame is set to 245 g (0.539 lbs.).

The frame body 2 consists of a hollow pipe made of fiber reinforced resin, namely, a laminate of fiber reinforced prepregs each consisting of a carbon fiber serving as the reinforcing fiber impregnated with an epoxy resin serving the matrix resin. The yoke 10 is made of a solid injection-molded material. More specifically, the yoke 10 is made of a material of 6-nylon, which is a thermoplastic resin, charged with 30% of the carbon fiber (short fiber) having a length of 1 mm (0.039 in.).

As described above, in the racket frame 1 of the first embodiment, after the frame body 2 and the yoke 10 are separately formed by molding the material, both are connected to each other by a mechanical connection means and an adhesive agent. Then a shear force generated when the racket frame 1 deforms is collectively applied to the connection surface of the frame body 2 and that of the yoke 10. Thereby it is possible to increase the vibration-damping performance of the racket frame 1. By appropriately setting the configuration of the main part 10A of the yoke body 10, the connection auxiliary part 10B, and the racket frame 1, the racket frame has high vibration-damping performance, while it has a favorable balance among its weight, rigidity, and strength.

Since the inner-side diameter of the string opening g which is formed on the yoke 10 is set larger than diameters of other portions of the string opening g, it is possible to utilize the length of the string effectively and thus enlarge the sweet area.

In one embodiment, the yoke and the frame body are connected with each other with the mechanical connection means and the adhesive agent. In addition, a vibration-damping film may be sandwiched between the connection surface of the yoke and that of the frame body. Thereby the racket frame has more improved vibration-damping performance. In one embodiment, an adhesive agent consisting of urethane is used. In addition, an adhesive agent superior in vibration-absorbing performance may be used depending upon the degree of required performance.

In one embodiment, because the yoke is formed by molding the thermoplastic resin, it is superior in moldability and vibration-damping performance. In addition, the yoke may be formed by molding the fiber reinforced resin as a hollow member. In this case, the yoke has a high strength and is lightweight.

EXAMPLES

The racket frame of each of examples 1–7 of the present invention and comparison examples 1 and 2 will be described below in detail.

The frame body of each of the examples and comparison examples is made of fiber reinforced resin. The frame bodies are hollow and have the same shape. More specifically, the frame body of each racket has a thickness of 24 mm (0.94 in.), a width of 13 mm–15 mm (0.51 in.–0.59 in.), and a ball-hitting area of 110 square inches (710 $cm^2$). They were prepared in the following method.

A prepreg sheet (CF prepreg (Toray T300, 700, 800, M46J)) made of fiber reinforced thermosetting resin containing carbon fiber serving as the reinforcing fiber ware layered at angles of 0°, 22°, 30°, and 90° on a mandrel (ϕ14.5) coated with an internal-pressure tube made of 66-nylon to mold the material into a vertical laminate. After the mandrel was removed from the laminate, the laminate was set in a die. In this state, the die was clamped and heated at 150° for 30 minutes, with an air pressure of 9 $kgf/cm^2$ (128 psi) kept in the internal tube to prepare specimens.

The material, characteristic, and weight of the yoke, the adhesive agent, the raw frame (weight/balance), and the racket frame (weight/balance) were set as shown in table 1.

TABLE 1

| | E1 | E2 | E3 | E4 | E5 | E6 | E7 | CE1 | CE2 |
|---|---|---|---|---|---|---|---|---|---|
| Material for yoke | 6-nylon/ CF short fiber | 6-nylon/ CF short fiber | 6-nylon/ CF short fiber | Epoxy/continuous fiber | Epoxy/continuous fiber | Epoxy/continuous fiber | Epoxy/continuous fiber | Epoxy/continuous fiber | |
| Characteristic of yoke | Concavity on yoke, Big hole (ϕ 7 mm (0.27 in)), mechanical connection | Concavity on yoke, mechanical connection | mechanical connection | big hole (ϕ 7 mm (0.27 in)), mechanical connection | big hole (ϕ 7 mm (0.27 in)), mechanical connection | mechanical connection | | One-piece molding of yoke and body Fiber reinforced + 17 g (0.037 lbs) | |
| Weight of yoke (g) (lbs) | 33 (0.073) | 33 (0.073) | 36 (0.079) | 28 (0.061) | 28 (0.062 lbs.) | 28 (0.062 lbs.) | 28 (0.062 lbs.) | 28 (0.062 lbs.) | — |
| Adhesive agent | Esprene | Three-bond 1530 | 3M Inc. DP460 | Esprene | Three-bond 1530 | Three-bond 2087 | 3M Inc. DP460 | 3M Inc. DP460 | — |
| Raw frame Weight/balance | 193/358 | 194/357 | 196/357 | 189/361 | 189/362 | 190/361 | 189/361 | 207/354 | 187/363 |
| Racket frame Weight/balance | 245/355 | 245/356 | 248/354 | 240/358 | 241/359 | 241/359 | 240/359 | 259/357 | 239/360 |

Example 1

The yoke was formed of a material composed of 6-nylon charged with 30% of the carbon fiber (short fiber) having a length of 1 mm (0.039 in). The solid yoke was formed by using an injection-molding die. A concavity was formed on the yoke. A convexity formed on the frame body of each racket was fitted on the concavity to mechanically connect the yoke and the frame body with each other.

A groove (concavity) having a width of 5 mm and a depth of 5 mm was disposed on the yoke at its ball-hitting side. The string opening of the yoke corresponding to the position of the five o'clock (seven o'clock) of the string-stretched part was set to 7 mm (0.27 in) which is larger than the ordinary diameter thereof. The thickness of the connection auxiliary part of the yoke was nonuniform. More specifically, the yoke had the same configuration as that of the first example. A slit was formed on the shaft part of the frame body to easily insert thereinto a projection formed at the portion where the leading end of the right connection auxiliary part is continuous with that of the left connection auxiliary part.

Example 2

The specification of the racket frame of the example 2 was similar to that of the example 1 except that the string opening (inner side in contact with ball-hitting face) of the yoke corresponding to the position of the five o'clock (seven o'clock) of the string-stretched part was set to 4.5 mm (0.018 in.) which is the normal diameter thereof and that a different kind of an adhesive agent was used.

Example 3

The specification of the racket frame of the example 3 was similar to that of the example 2 except that the concavity was not formed on the yoke and that a different kind of an adhesive agent was used.

Example 4

The configuration of the racket frame of the example 4 was similar to that of the example 1 except that the concavity was not formed on the yoke and that the material and the manufacturing method were different from those of the example 1.

The yoke was formed by molding the fiber reinforced resin consisting of the carbon fiber (continuous fiber) and the epoxy resin. Two hollow layups were integrally molded with a nylon tube disposed as an inner layer to form an approximately triangular hollow member. The hollow member was cut to form the yoke. That is, the yoke was formed of the same material as that of the frame body. Unlike the injection-molded product, openings for strings were formed on the yoke after the molding was made.

Example 5

The specification of the racket frame of the example 5 was similar to that of the example 4 except that a different kind of an adhesive agent was used.

Example 6

The specification of the racket frame of the example 6 was similar to that of the example 5 except that the diameter of the string opening (inner side of the string opening contacts ball-hitting face) of the yoke corresponding to the position of the five o'clock (seven o'clock) of the string-stretched part was set to the normal diameter of 4.5 mm (0.18 in.) and that a different kind of an adhesive agent was used.

Example 7

The yoke and the frame body were connected with each other not by a mechanical means but by an adhesive agent. The specification of the racket frame of the example 7 was similar to that of the example 6 except that the kind of the adhesive agent and the connecting method were different from those of the example 6.

Comparison Example 1

The specification of the racket frame of the comparison example 1 was similar to that of the example 6 except that the frame body and the yoke formed in advance by molding the material respectively were connected to each other not by a mechanical means.

Comparison Example 2

The specification of the racket frame of the comparison example 2 was similar to that of the comparison example 1 except that the yoke and the frame body were integrally molded by the conventional method, with the unhardened material for the yoke and the unhardened material for the frame body set together in a die.

The racket frame of each of the examples 1–7 and comparison examples 1 and 2 was measured by the method which will be described later on the frequency in an out-of-plane primary vibration, the out-of-plane primary vibration-damping factor, the frequency in an out-of-plane secondary vibration, the out-of-plane secondary vibration-damping factor, and the restitution coefficient (three points). A durability test was also conducted. Table 2 shows the test result.

TABLE 2

| | E1 | E2 | E3 | E4 | E5 | E6 | E7 | CE1 | CE2 |
|---|---|---|---|---|---|---|---|---|---|
| Frequency (Hz) in out-of-plane primary vibration | 163 | 160 | 164 | 171 | 169 | 172 | 171 | 180 | 164 |
| Damping factor (%) in out-of-plane primary vibration | 0.9 | 1.1 | 0.8 | 0.6 | 0.7 | 0.5 | 0.5 | 0.4 | 0.3 |
| Frequency (Hz) in out-of-plane secondary vibration | 455 | 449 | 458 | 467 | 463 | 471 | 472 | 480 | 464 |
| Damping factor (%) in out-of-plane secondary vibration | 1.0 | 1.9 | 0.8 | 0.9 | 1.7 | 0.9 | 0.8 | 0.5 | 0.3 |
| Durability test | OK | OK | OK | OK | OK | OK | OK | NG 908 crack | OK |
| Restitution coefficient at face center | 0.424 | 0.422 | 0.410 | 0.416 | 0.417 | 0.402 | 0.403 | 0.414 | 0.402 |
| Restitution coefficient at position (X) 80 mm (3.1 in.) below face center | 0.387 | 0.384 | 0.360 | 0.373 | 0.371 | 0.354 | 0.351 | 0.363 | 0.348 |
| Restitution coefficient 50 mm (1.9 in.) laterally from position (X) | 0.355 | 0.337 | 0.329 | 0.346 | 0.344 | 0.332 | 0.328 | 0.330 | 0.325 |

where E denotes example and CE denotes comparison example.

Measurement of Out-of-plane Primary Damping Factor

As shown in FIG. 8A, with the upper end of the string-stretched part 3 hung with a string 51, an acceleration pick-up meter 53 was installed on one connection portion between the string-stretched part 3 and the throat part 4, with the acceleration pick-up meter 53 perpendicular to the face of the racket frame. As shown in FIGS. 8B, in this state, the other connection portion between the string-stretched part 3 and the throat part 4 was hit with an impact hammer 55 to vibrate the racket frame. An input vibration (F) measured by a force pick-up meter installed on an impact hammer 55 and a response vibration ($\alpha$) measured by the acceleration pick-up meter 53 were inputted to a frequency analyzer 57 (dynamic single analyzer HP3562A manufactured by Fuhret Packard Inc.) through amplifiers 56A and 56B. A transmission function in the frequency region obtained by an analysis was calculated to obtain the frequency of the racket frame. The vibration-damping ratio ($\zeta$) of the racket frame, namely, the out-of-plane primary vibration-damping factor thereof was computed by an equation shown below. Table 2 shows the average of values obtained by measurement and computation performed for a plurality of the racket frames of each of the examples and the comparison examples.

$$\zeta=(1/2)\times(\Delta\omega/\omega n)$$

$$To=Tn/\sqrt{2}$$

Measurement of Out-of-plane Secondary Vibration-damping Factor

As shown in FIG. 8C, with the upper end of the gut-stretched part 3 of the racket frame hung with the string 51, the acceleration pick-up meter 53 was installed on one connection portion between the throat part 4 and the shaft part 5, with the acceleration pick-up meter 53 perpendicular to the face of the racket frame. In this state, the rear side of the racket frame at a portion thereof confronting the pick-up meter-installed position was hit with the impact hammer 55 to vibrate the racket frame. The damping factor, namely, the out-of-plane secondary vibration-damping factor of the racket frame was computed by a method equivalent to the method of computing the out-of-plane primary vibration-damping factor. Table 2 shows the average of values obtained by measurement and computation performed for a plurality of the racket frames of each of the examples and the comparison examples.

Method of Testing Durability

The grip part of each racket frame was fixed with an intermediary of a rubber hose. A ball collided with the ball-hitting face of the racket frame at a speed of 75 m/sec (247.5 ft/sec) at a position 10 cm (3.9 in.) apart from the top of the string-stretched part to count the number of breakage times at smaller number of collision times by making the ball speed much higher than the normal speed in a tennis-playing time. Strings were stretched on each racket frame at a tensile force of 65 lb (291 N) for warp and 60 lb (269 N) for weft. The racket frames that could not clear 1,600 times were denoted by NG.

Measurement of Restitution Coefficient

Figure 9:
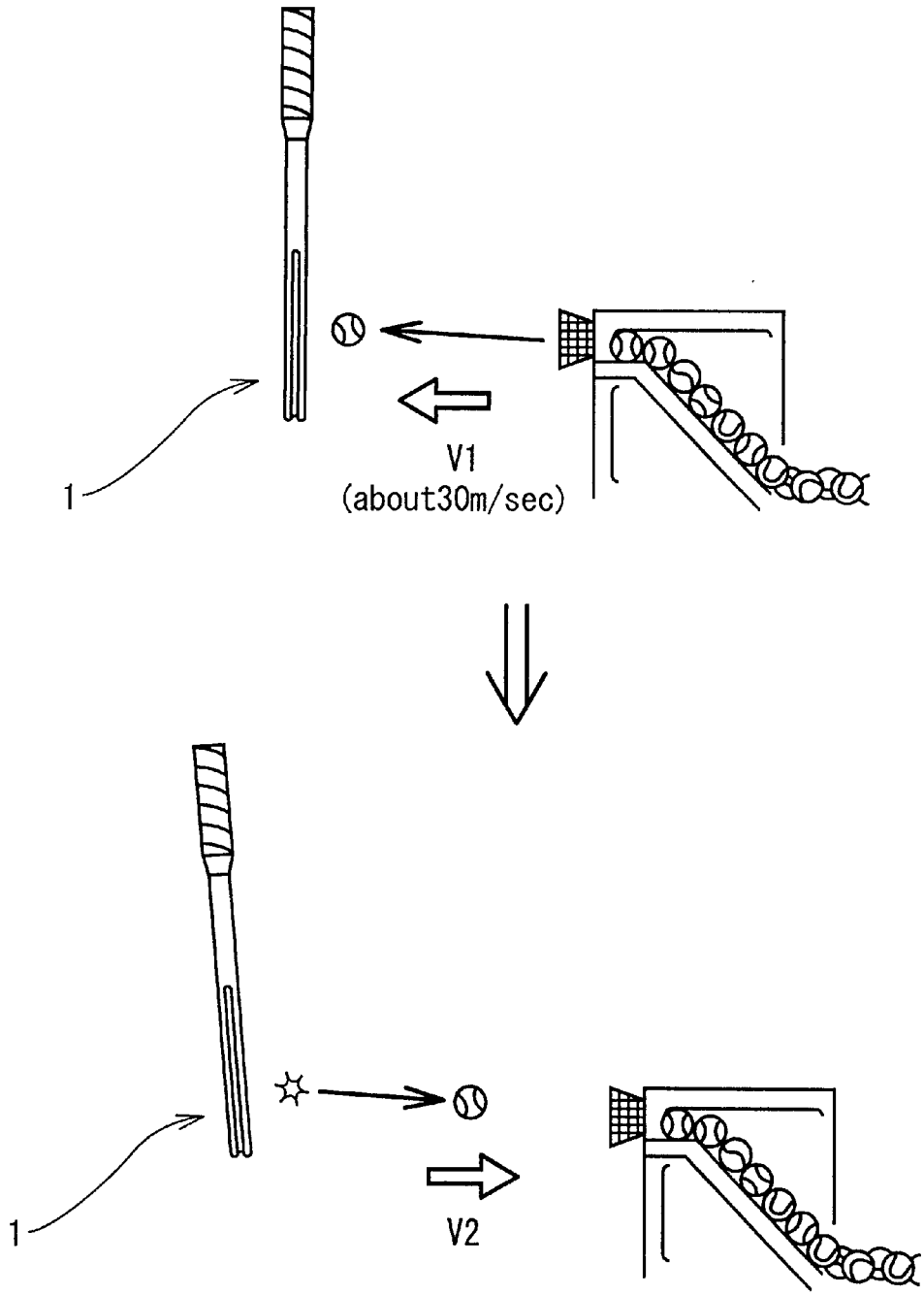
FIG. 9 shows a method of measuring a restitution coefficient.

As shown in FIG. 9, the racket frame 1 of each of the examples and comparison examples was hung gently and vertically in such a way that the grip part was free. A tennis ball was launched from a ball launcher at a constant speed of V1 (30 m/sec (99 ft/sec)) to allow the tennis ball to collide with the ball-hitting face of the racket frame. The rebound speed V2 of the tennis ball was measured. The restitution coefficient is the ratio of the rebound speed V2 to the launched speed V1. The larger the restitution coefficient is, the longer the tennis ball flies. The restitution coefficient at the center (face center) of the ball-hitting face, the restitution coefficient at a position (X) 80 mm (3.1 in.) below the face center, and the restitution coefficient at a position 50 mm (1.9 in.) lateral from the position (X) were measured. Table 2 shows the average of three values obtained at each of the three points. That is, the restitution coefficient of each racket frame was measured at the three points.

As shown in tables 1 and 2, in each of racket frames of the examples 1–7, the damping factor of the out-of-plane primary vibration was in the range of 0.5–1.1, and the damping factor of the out-of-plane secondary vibration was in the range of 0.8–1.9. On the other hand, in each of the racket frames of the comparison examples 1 and 2, the damping factor of the out-of-plane primary vibration was in the range of 0.3–0.4, and the damping factor of the out-of-plane secondary vibration was in the range of 0.3–0.5. Therefore it was confirmed that the racket frames of the examples 1–7 of the present invention ware superior to those of the comparison examples 1 and 2 in the vibration-damping performance thereof.

In the durability test, the racket frames of the examples 1–7 had favorable results, whereas the racket frame of the comparison example 1 cracked when the tennis ball collided therewith 908 times. The racket frames of the examples 1–7 had higher values than the racket frames of the comparison examples 1 and 2 in the restitution coefficient at each of the three points of the ball-hitting face. Thus the former has a wider sweet area than the latter and is superior to the latter in the restitution performance.

As apparent from the foregoing description, according to the present invention, after the frame body and the yoke are separately formed by molding the material for each of the frame body and the yoke, the yoke and the frame body are connected to each other by a mechanical connection means. A shear force generated when the racket frame deforms is collectively applied to the connection surface of the frame body and that of the yoke to increase the vibration-damping performance of the racket frame. Since the vibration-damping performance of the racket frame is improved by the connection between a plurality of separate members, as described above, the racket frame is lightweight. In addition, since the yoke and the frame body are connected to each other by a mechanical connection means, the racket frame has a high vibration-damping performance without deteriorating its rigidity.

The area of the connection surface of the frame body (the area of the connection surface of the yoke) can be adjusted, the material and the adhesive agent are selected appropriately, and the configuration of the yoke body, the connection auxiliary part, and the racket frame to control the vibration-damping degree of the racket frame according to players' preferences for the degree of vibration generated when they hit a tennis ball. Therefore according to the present invention, it is possible to design a racket frame suitable for players.

Unlike the conventional racket frame, the inner-side diameter of the string opening which contacts the ball-hitting face of the racket frame is set large. Therefore it is possible to prevent the dislocation of the string opening and utilize the length of the string effectively and thus enlarge the sweet area.

What is claimed is:

1. A racket frame comprising a frame body and a yoke connecting right and left parts of the frame body to each other;

wherein the yoke and the frame body are connected by a mechanical connection means and/or an adhesive agent, with both ends of the yoke in contact with the right and left parts of the frame body in an area of not less than 10 $cm^2$, the yoke has right and left connection auxiliary parts each extending from one end of a main part of the yoke that closes an opening of a string-stretched part of the frame body, each of the right and left connection auxiliary parts extending across a boundary between the string-stretched part and a throat part of the frame body;

each of the right and left connection auxiliary parts of the yoke is extended to a shaft part along an inner surface of the throat part in such a way that a leading end of the right connection auxiliary part is continuous with that of the left connection auxiliary part to form an approximately hollow triangular space with the connection auxiliary part and the main part of the yoke.

2. The racket frame according to claim 1, wherein the frame body is composed of a pipe formed by one-piece molding of a fiber reinforced resin and has a string-stretched part surrounding a ball-hitting face, a throat part, a shaft part, and a grip part; the yoke consists of a fiber reinforced resin, a resin or a metal or a composite material thereof; and the mechanical connection means includes a fit-on of a concavity and a convexity or/and screw-tightening.

3. The racket frame according to claim 1, wherein an adhesive agent superior in vibration-absorbing property and optionally a vibration-damping film or a vibration-damping sheet are interposed between a connection surface of the frame body and the yoke.

4. The racket frame according to claim 1, wherein a vibration-damping film or a vibration-damping sheet is interposed between a connection surface of the frame body and the yoke.

5. The racket frame according to claim 1, wherein each of the right and left connection auxiliary parts is extended up to a position of four o'clock and eight o'clock, respectively of the string-stretched part, supposing that the string-stretched part is a clock face;

and each of the right and left connection auxiliary parts is extended up to the shaft part; and each of the right and left connection auxiliary parts has an equal and uniform dimension in one region and a nonuniform dimension in other region in a thickness direction thereof.

6. The racket frame according to claim 1, wherein the yoke has a projection projected from a portion at which the leading end of the right connection auxiliary part is continuous with the leading end of the left connection auxiliary part toward the shaft part and the projection is inserted into a slit formed at a center of a leading end of the shaft part.

7. The racket frame according to claim 1, wherein an inner-side diameter of a string opening which is formed on the yoke and the frame body and which contacts a ball-hitting face of the racket frame is larger than other portions of the string opening.

8. The racket frame according to claim 1, wherein a weight of the yoke is set to a range of 5%–30% of a weight of a raw frame weight that is the sum of the weight of the yoke and the frame body.

9. A racket frame having a frame body and a yoke connecting right and left parts of the frame body to each other, wherein the yoke and the frame body are connected by a mechanical connection means and/or an adhesive agent, with both ends of the yoke in contact with the right and left parts of the frame body in an area of not less than 10 $cm^2$, the yoke has right and left connection auxiliary parts each extending from one end of a main part of the yoke that closes an opening of a string-stretched part of the frame body, with each of the right and left connection auxiliary parts extending across a boundary between the string-stretched part and a throat part of the frame body;

both ends of the main part of the yoke and a connection auxiliary part extending from both ends of the main part of the yoke are connected to an inner-surface side of the frame body by superimposing an outer surface of the connection auxiliary part and an inner surface of the frame body on each other or by fitting the connection auxiliary part on a fit-on portion formed on the inner surface of the frame body in correspondence to a configuration of the connection auxiliary part.

10. The racket frame according to claim 9, wherein the frame body is composed of a pipe formed by one-piece molding of a fiber reinforced resin and has a string-stretched part surrounding a ball-hitting face, a throat part, a shaft part, and a grip part;

the yoke consists of a fiber reinforced resin, a resin or a metal or a composite material thereof; and the mechanical connection means includes a fit-on of a concavity and a convexity or/and screw-tightening.

11. The racket frame according to claim 9, wherein an adhesive agent superior in vibration-absorbing property and optionally a vibration-damping film or a vibration-damping sheet are interposed between a connection surface of the frame body and the yoke.

12. The racket frame according to claim 9, wherein a vibration-damping film or a vibration-damping sheet is interposed between a connection surface of the frame body and the yoke.

13. The racket frame according to claim 9, wherein each of the right and left connection auxiliary parts is extended up to a position of four o'clock and eight o'clock, respectively of the string-stretched part, supposing that the string-stretched part is a clock face;

and each of the right and left connection auxiliary parts is extended up to the shaft part; and each of the right and left connection auxiliary parts has an equal and uniform dimension in one region and a nonuniform dimension in other region in a thickness direction thereof.

14. The racket frame according to claim 9, wherein the yoke has a projection projected from a portion at which the leading end of the right connection auxiliary part is continuous with the leading end of the left connection auxiliary part toward the shaft part and the projection is inserted into a slit formed at a center of a leading end of the shaft part.

15. The racket frame according to claim 9, wherein an inner-side diameter of a string opening which is formed on the yoke and the frame body and which contacts a ball-hitting face of the racket frame is larger than othe portions of the string opening.

16. The racket frame according to claim 9, wherein a weight of the yoke is set to a range of 5%–30% of a weight of a raw frame weight that is the sum of the weight of the yoke and the frame body.

* * * * *